United States Patent [19]

Serata

[11] 4,149,409

[45] Apr. 17, 1979

[54] BOREHOLE STRESS PROPERTY MEASURING SYSTEM

[76] Inventor: Shosei Serata, 1229 - 8th St., Berkeley, Calif. 94710

[21] Appl. No.: 851,147

[22] Filed: Nov. 14, 1977

[51] Int. Cl.[2] ..... E21B 49/00

[52] U.S. Cl. ..... 73/151

[58] Field of Search ..... 73/84, 88 E, 151,

[56] References Cited

U.S. PATENT DOCUMENTS

| | | | |
|---|---|---|---|
| 2,957,341 | 10/1960 | Menard | 73/84 |
| 3,872,717 | 3/1975 | Fox | 73/84 |

*Primary Examiner*—Jerry W. Myracle

*Attorney, Agent, or Firm*—Harris Zimmerman

[57] ABSTRACT

A borehole stress property measuring system for in situ determination of stress states as well as material properties of soil and rock media includes two axially aligned adjacent cylindrical members disposed in a borehole. One cylindrical member is provided with at least four pair of diametrically opposed pistons which are hydraulically actuated to impinge on the borehole wall under various pressure loading conditions. The pairs of pistons are axially spaced and angularly offset, each from the other, so that accurate measurement of the outward extension of the pistons under various pressure loading conditions reveals such material properties as elasticity, isotropy, compressibility, and the like. The second cylindrical member includes expandable four-quadrant pressurizing chambers to apply differential pressure to and simultaneously measure deformation of the borehole boundary for determining the existing stress conditions in the underground media.

29 Claims, 26 Drawing Figures

BOREHOLE STRESS PROPERTY MEASURING SYSTEM

BACKGROUND OF THE INVENTION

Knowledge of the in situ stresses and material properties of the earth's crust and surficial deposits is essential for rational analysis of geological and man-made structures. Determination of in situ stresses and material properties based on laboratory testing of core samples may result in unacceptably large errors, due to property deterioration of samples which have been removed from their natural location. In situ measurement of stresses and properties can eliminate these errors, yet suitable instrumentation for gathering in situ data has not been available in the prior art.

Important applications of in situ stress and property measurement occur in geotechnical engineering. The load on underground structures cannot be calculated without first determining the preexisting stress field in the underground media. Underground openings are being used increasingly for transportation systems and storage facilities; this increased use emphasizes the need for rational design procedures based on an accurate assissment of in situ stress and material conditions. The in situ stress conditions in underground media are also a major factor in the design of foundations for major structures. Among the more important applications are underground cavities for the storage of liquids, gasses, and solids, including such materials as oil, gas, compressed air, petrochemicals, and nuclear wastes. Also, the safe design of mine openings, both for conventional and solutioned mines, requires an accurate knowledge of existing stress states in the surrounding underground media. This is also true in the design of tunnels, galleries for hydropower generators, and foundations for large structures such as dams, high-rise buildings, and offshore platforms. An important application of in situ stress and property measurement maybe found in future prediction of earthquakes. The accurate determination of in situ stresses and their time-dependent change is necessary to improve our understanding of regional geological stress fields and the dynamics of tectonic plate systems. Quantitative evaluation of local stresses and material properties along fault planes is also of major importance in the development of procedures for predicting earthquakes. The prior art reveals a paucity of devices which can achieve such quantitative evaluation over long periods of time while disposed in a borehole in seismically active geological formations.

The prior art instrumentation for the determination of in situ stress fields and material properties are broadly classified into three categories: pressure meters, hydraulic fracturing devices, and overcoring methods.

Hydraulic fracturing and overcoring methods are limited to applications in competent rock. Neither method gathers any data related to material properties. Overcoring techniques are difficult, time-consuming, and rather expensive to perform. Furthermore, none of these techniques are applicable in ground media not ideally uniform and elastic. Also, the depth at which measurements can be made is restricted by the need to overcore and perform complex manipulations from outside the borehole. As is the case for the overcoring method, the interpretation of results from hydraulic fracturing methods relies on the assumption of linear elasticity and homogeneity. It is also assumed that one of the principle stresses in the ground media is parallel to the borehole axis. Therefore, the hydrofracturing method is not applicable in those cases in which the stress in the direction parallel to the borehole is substantially smaller than the stress in the other principal directions. Furthermore, hydraulic fracturing techniques cannot be used in ground media which is already fractured or which is highly permeable.

A variety of simple pressure meters has been developed to measure the elastic modulae of rocks through analysis of volume changes in a pressurized cell introduced into a borehole. More advanced forms of this type of instrument have been developed for the determination of lateral earth pressure in soils at rest, as well as for the determination of some generalized material properties and bore pressures. These instruments cannot discriminate nor detect the directional components of stress fields and their depth capabilities are limited by the available soil mechanics boring equipment.

None of the prior art techniques are applicable to in homogenious, anisotropic ground, as none yields information regarding the visco-elastic and visco-plastic time dependent rheological material properties of earth materials.

SUMMARY OF THE PRESENT INVENTION

The present invention generally comprises a borehole probe which is capable of measuring in situ properties of the ground media surrounding the borehole, as well as the ambient stress field within the ground media. It generally comprises a pair of cylindrical members which are axially aligned and disposed in adjacent relationship within the borehole. One cylindrical member supports multiple piston penetrometers which are axially spaced and angularly offset within the cylindrical member. The penetrometers are driven diametrically outwardly against the sides of the borehole by hydraulic pressure. Both the magnitude and the rate of change of piston penetration with respect to hydraulic actuating pressure are measured and recorded electronically. The material properties of the ground media, including directional variations and time dependent properties, are determined by analysis of the penetrometer data using a rheological type finite element computer simulation model of the interaction of the pistons with the borehole wall.

The other cylindrical member is a stress-memeasuring instrument that houses four pressurized cells which are arrayed in quadrant relationship about the axis of the cylindrical member. Two opposing quadrants are hydraulically expanded at high pressure while the other two quadrants are maintained at low pressure. The resulting distortion of the borehole and the rate of distortion are monitored and also recorded electronically. The degree and configuration of borehole distortion are a function of both the material properties and ambient state of stress in the ground surrounding the borehole and may be determined by comparison with the behavior of rheological finite element computer simulation models. The directional components of the stress field can be discriminated by performing measurements with the probe set at various angular orientations within the borehole. The material properties determined by the interpretation of the data from the penetrometers are employed in the computer model analysis to provide an accurate representation of the stress field surrounding the borehole.

A BRIEF DESCRIPTION OF THE DRAWINGS

DESCRIPTION OF THE PREFERRED EMBODIMENT

Figure 1:
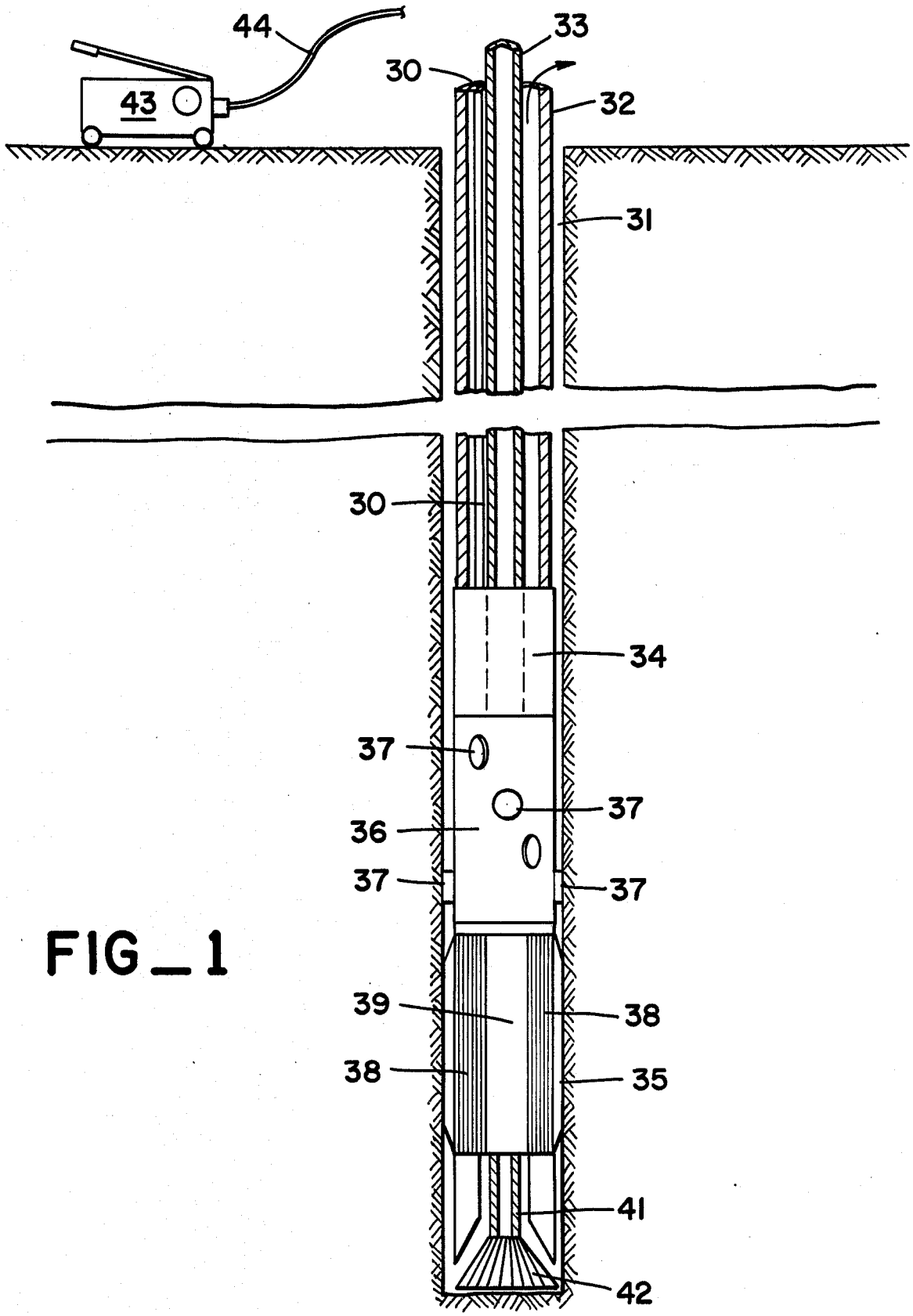
FIG. 1 is a side view of the stress and property measuring instrument of the present invention disposed in a borehole.

As shown in FIG. 1, the stress and property measuring instrument of the present invention generally comprises a cylindrical ground media property sensing probe 36 which supports a plurality of paired, diametrically opposed penetrometer pistons 37. The pistons 37 are controllably impinged upon the wall of a borehole 31 in which the instrument is disposed to determine material properties of the surrounding ground media, as will be explained in the following. Directly adjacent and axially aligned with the probe 36 is a cylindrical stress probe 35. The stress probe 35 includes a pair of opposed high-pressure expandable chambers 38, and a pair of opposed low pressure expandable chambers 39, all of the chambers being arrayed in quadrant relationship about the axis of the probe 15.

Disposed directly above the probe 36 is a cylindrical supporting chamber 34, which contains microprocessor electronics which operate on the signals generated in the probe portions 35 and 36. These signals are then conducted to the recording and interpreting instrumentation on the earth's surface through a conductor cable (not shown). The hydraulic pressure necessary to operate the pistons 37 and the expandable chambers 38 and 39 provided through a casing pipe 32. The drilling pipe 33 extends to the supporting chamber 34, which includes an hydraulic pressure regulator to control the pistons and the expandable chambers. A drilling rod extension 41 extends through an axial bore in the supporting chamber 34, and the probe portions 35 and 36, and terminates in a drill head 42. Thus it may be appreciated that the construction shown in FIG. 1, provides for drilling of the borehole as well as the measurement of local stress and material property conditions, whenever required, in one continous procedure.

The high pressure hydraulic fluid is provided by a pump 43 on the earth's surface through a flexible hose 44 to the interior bore of the casing pipe 32. The outer casing pipe 32 provide with a protected channel 30 through which the hydraulic and electronic connections to the probes are made.

Figure 4:
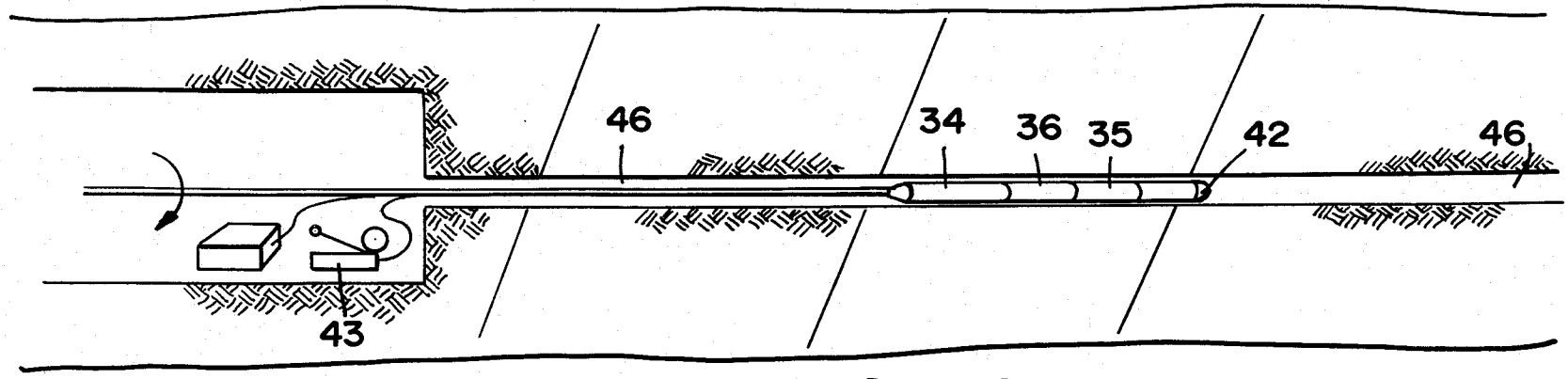
FIG. 4 is a side view of the present invention shown disposed in a horizontal borehole.

As shown in FIG. 4, the stress property measuring instrument of the present invention may be used equally effectively in a horizontal borehole 46. The arrangement and function of the elements of the instrument are substantially as described in the foregoing.

Figure 2:
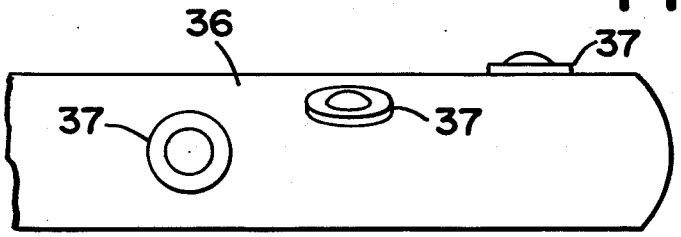
FIG. 2 is a perspective view of the property measuring portion of the present invention, showing the arrangement of the penetrometer pistons.
Figure 3:
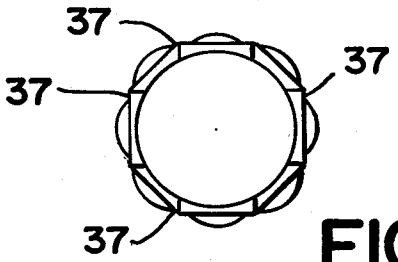
FIG. 3 is an end view of the stress measuring portion of the present invention, as shown in FIG. 2.

With reference to FIGS. 2 and 3, the penetrometer pistons of the property measuring portion 36 are arranged in diametrically opposed pairs. In the preferred embodiment at least four pairs of penetrometer pistons are employed to determine the material properties of the ground media immediately adjacent to the borehole wall. Each pair of pistons 37 is angularly offset from the others about the axis of the cylindrical member 36. Thus the properties measurement is carried out in different direction and different axial spacing so that the isotropy and uniformity of the ground media may be determined.

Figure 8:
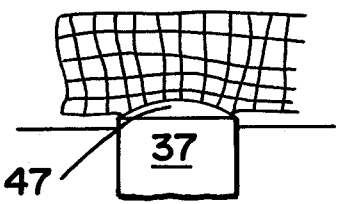
FIGS. 7 and 8 are schematic representations of the deformation patterns caused by the penetrometer pistons whown in FIGS. 5 and 6 respectively.
Figure 7:
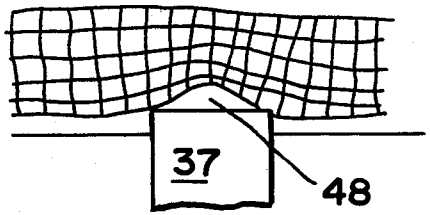
Figure 6:
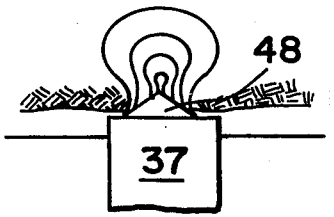
FIGS. 5 and 6 are schematic view of the stress contour lines caused by differing penetrometer piston contact ends.
Figure 5:
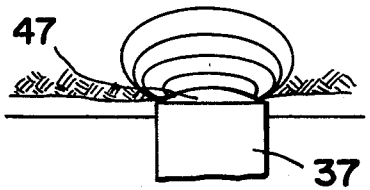

The material properties are measured by analyzing the penetration of the piston ends into the boundary media of the borehole, and measuring the extent and velocity of penetration as well as the pressure loading and unloading of the penetrometers. Furthermore, as shown in FIGS. 5 and 6, the penetrometer ends may be provided with a broad contacting dome 47, or a conical pointed contact end 48. The different contact geometry of the penetrometers results in deformation of different stress contour lines, and also affects the measured extension and velocity of the penetrometers. This is due to the fact that the contact geometry of the penetrometers determines the deformation pattern of the borehole wall, as shown in FIGS. 7 and 8. Thus, it is important to consider the contact geometry in conjunction with the penetrometer data in the rheological finite element computer simulation model which correlates these factors to determine the material properties of the borehole wall.

Each pair of penetrometer piston assemblies 37 includes a pair of diametrically opposed bores 52 extending to the periphery of the cylindrical member 36. It should be noted that the inner ends of the bores 52 do not communicate with the axial passage 51 in the member 36. Secured in a counterbore in the distal end of each bore 52 is a sleeve 54. A piston 56 is slidably received in the sleeve 54, and an O-ring seal 57 therein provides a pressure sealing engagement with the piston.

The proximal end of each piston 56 is provided with a radially outwardly extending flange 58 which slidably contacts the bore 52. The flange 58 retains an O-ring seal 59 which also forms a pressure seal with the bore 52. The piston 56 also includes an axially extending passageway 61. Disposed in the passageway is the sensing coil 62 of linear variable displacement transformer, which is fixed to the cylindrical member 36. The sensing coils themselves have a central passageway therethrough in which the transformer core 63 is disposed. The transformer core is connected by thin rod to the distal end of the piston 56. It may be appreciated that as the pistons 56 are driven outwardly by hydraulic pressure, the cores 63 are displaced with respect to their sensing coils 62, and a linearly varying electrical signal is produced by the LVDT.

Figure 12:
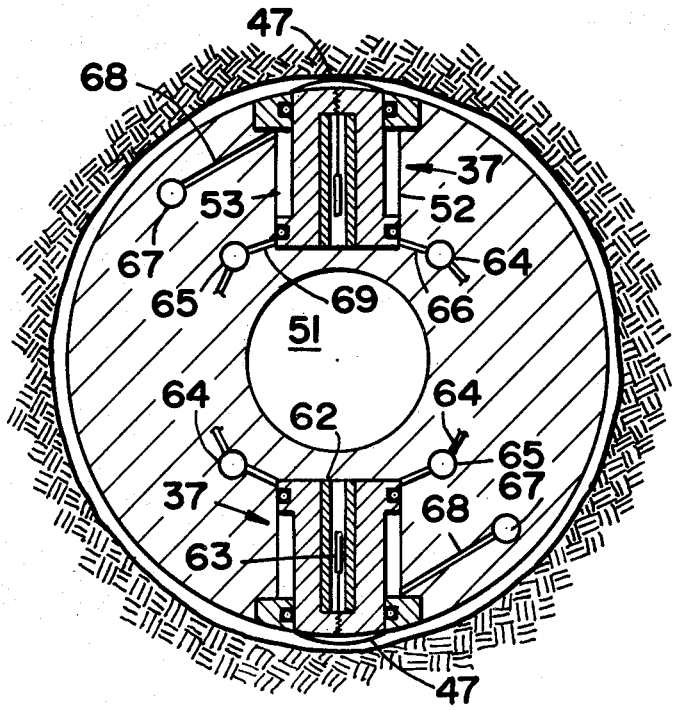
FIG. 12 is a transaxial cross-sectional view of the assembly shown in FIG. 11.

With particular reference to FIG. 12, the high pressure hydraulic fluid is provided to the penetrometers by a pair of hydraulic galleries 64 which extend parallel to the axis of the cylindrical member 36. The galleries 64 are connected to the penetrometer assemblies by means of tubes 66 formed in the member 36. The galleries 64 extend the length of the member 36, each gallery providing high pressure hydraulic fluid to at least two penetrometer cylinders.

The cylindrical member 36 also includes at least a pair of galleries 67 extending parallel to the axis and connected to the proximal ends of the penetrometer cylinders by means of passages 68. The galleries 67 provide low pressure hydraulic fluid to the distal side of the flange 58 to force the pistons 56 to retract. It should be noted that no part of the penetrometer assembly or hydraulic fluid supply affects the clearance through the axial bore 51 which is provided so that the drilling rod may extend through the instrument of the present invention.

Electric wires from the sensing coils lead to another pair of longitudinal galleries 65 through the connecting holes 69. The electric wires in the galleries are connected to the electronic control system in the supporting chamber 34.

Figure 9:
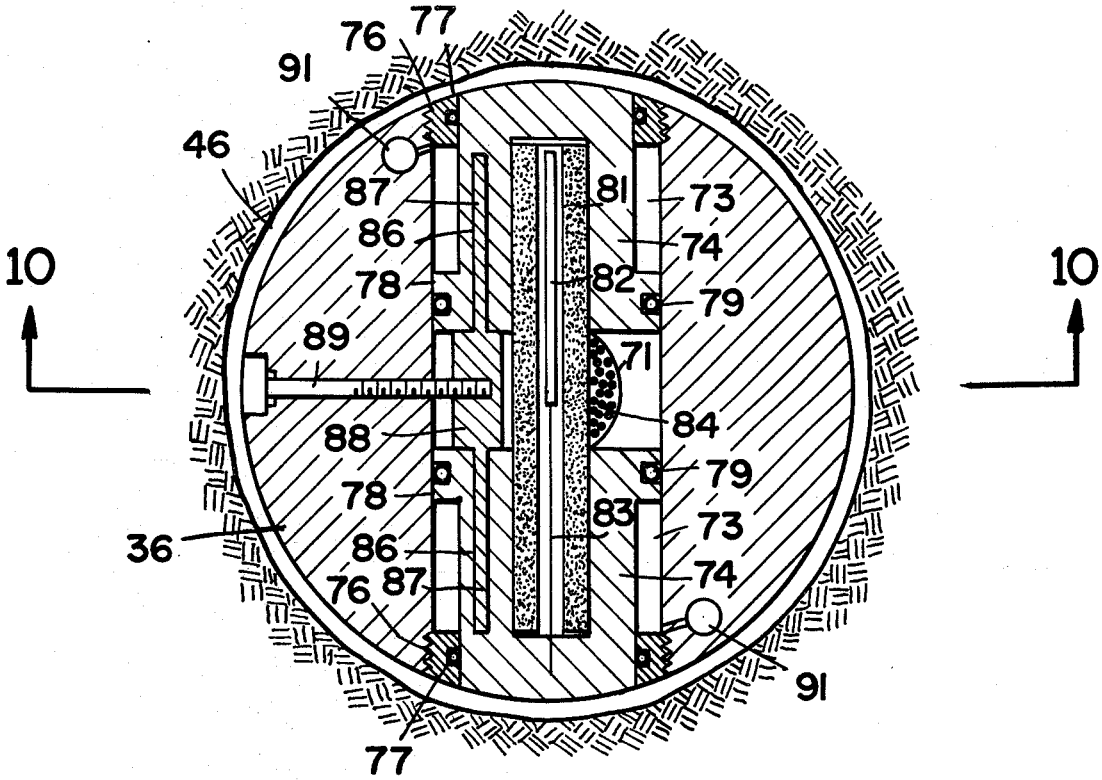
FIG. 9 is a cross-sectional view of a penetrometer piston assembly of the present invention without center drill hole.
Figure 10:
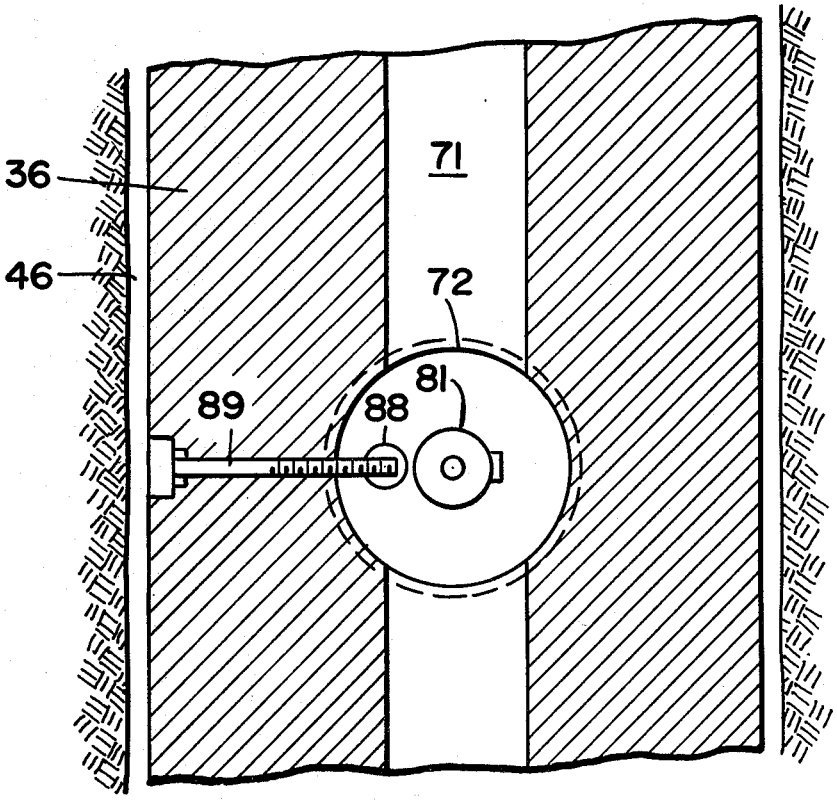
FIG. 10 is an axial cross-sectional view of the penetrometer piston assembly shown in FIG. 9.
Figure 11:
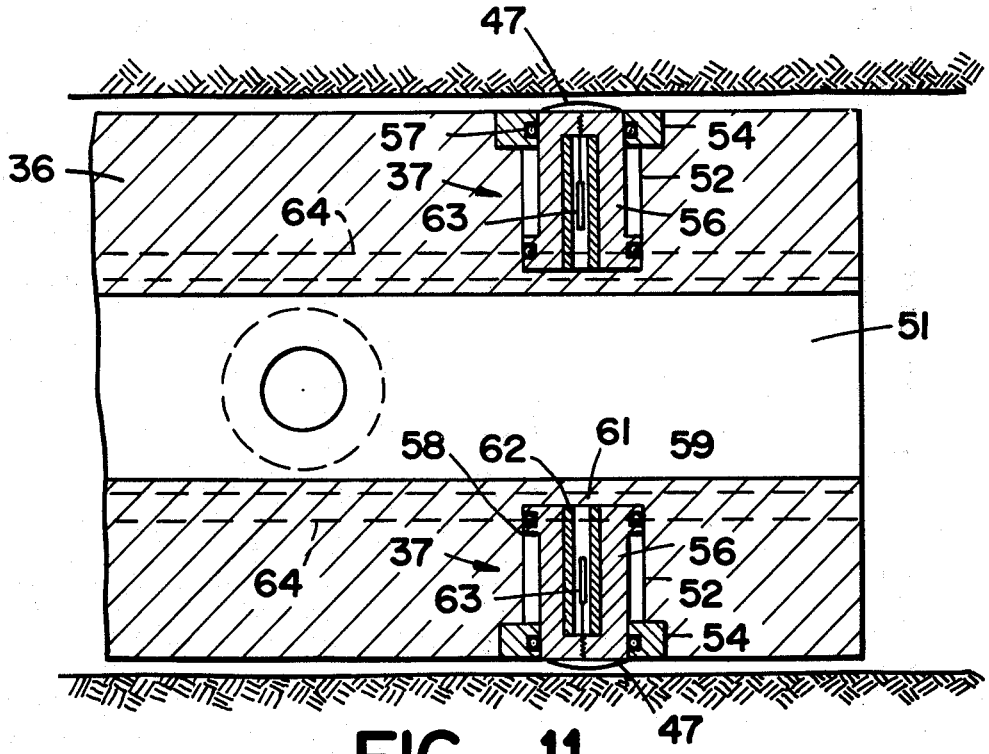
FIG. 11 is an axial cross-sectional view of a further embodiment of the penetrometer piston assembly of the present invention with the center drill hole.

With reference to FIGS. 9 and 10, the present invention also includes an alternative embodiment which does not provide an axial bore for the drilling rod. The cylindrical member 36 is instead provided with an axial passageway 71 which supplies high pressure hydraulic fluid to the penetrometer piston assemblies 72. Each piston assembly includes a bore 73 extending diametrically through the cylindrical body 36. Disposed at the outer end of the bore 73 are a pair of sleeves 76. Secured within the bore 73 are a pair of pistons 74 which are dimensioned to slidably extend through the sleeves 76. Each sleeve is provided with an O-ring seal 77 to effect a pressure seal with the respective piston. Each piston also includes a flange 78 extending radially outwardly from the proximal end thereof, and contacting the bore 73 in slidable fashion. Each flange 78 supports an O-ring seal 79 which effects a pressure seal with the surface of the bore 73.

Each of the pistons 74 is provided with a hollow axial cavity, the cavities being aligned each with the other. The sensing coil of a linear variable displacement transformer extends the length of both of the aligned cavities, and is secured to one of the pistons 74. Disposed in the central chamber of the sensing coil is a movable core 82 which is secured to the other piston 74 by means of a thin rod 83. It may be appreciated that as high pressure hydraulic fluid is provided to the inner surfaces of the pistons, through the passageway 71, the pistons are driven outwardly to impinge on the wall of the borehole 46. This relative displacement causes relative motion between the core 82 and the sensing coil 81, effecting a change in the signal therefrom. This signal, along with the signals from the posed in the central passageway 71 to a signal processing device located in the supporting chamber 34.

Each of the pistons 74 is provided with a hole 86 therein disposed parallel to the axes of the piston. The opposed arms 87 of a guide member 88 are slidably secured in the holes 86 to assure angular alignment of the pistons about their common axis. A screw 89 is threadedly secured in the member 88 and in a threaded hole in the cylindrical member 36 to prevent any angular displacement of the member 88 or the pistons 74. This feature is significant in that any relative angular displacement of the piston 74 would seriously damage the wire connection to the LVDT.

Also disposed in the cylindrical member 36 are a pair of low pressure galleries 91 which communicate with the distal ends of the bore 73. The low pressure provided to the galleries 91 is used selectively to retract the pistons 74 through fluid impingement upon the distal surfaces of the flange 78. Thus the pistons may be retracted as desired whenever a testing procedure is completed.

In either embodiment of the penetrometers, the LVDT transducers associated therewith provide accurate data relating the displacement of the penetrometers as a functionn of time to the pressure applied by the penetrometers and the geometry of the contacting surface. In this way the material properties of the ground media surrounding the borehole may be determined. It may be appreciated that transducers other than the LVDT type may be employed as desired.

Figure 14:
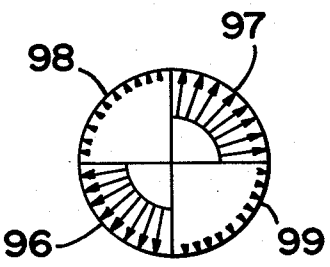
FIG. 14 is a cross-sectional schematic view of the differential pressure-loading on the borehole wall provided by the stress measuring portion of the present invention.

In addition to the material properties measuring portion 36 of the present invention, there is also provided the portion 35 which is used to determine the existing stress field in the ground media surrounding the borehole. With reference to FIGS. 13 to 17, the stress measuring portion 35 includes a pair of diametrically opposed, high pressure inflatable chambers 96 and 97, and a pair of diametrically opposed, low pressure inflatable chambers 98 and 99. The chambers 96 – 99 are disposed in quadrant relationship about the axis of the member 35, and extend longitudinally along a major extent of the member 35. As shown in FIG. 14, the high pressure chambers 96 and 97 exert a very large force on the borehole wall, on the order of ten thousand psi, while the low pressure which inflates the chambers 98 and 99 biases the outer walls thereof into contact with the borehole wall.

Figure 17:
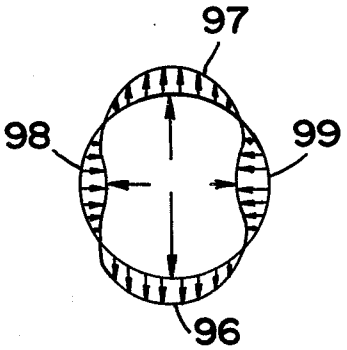
FIG. 17 is a cross-sectional schematic view of the radial displacement pattern caused by the stress-measuring portion of the present invention.
Figure 13:
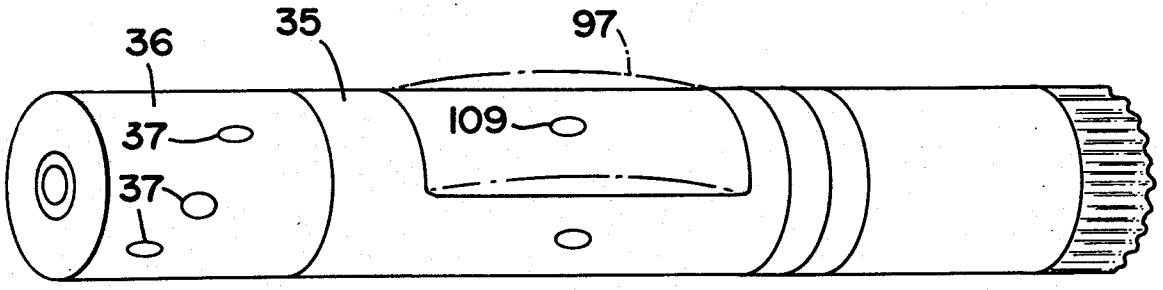
FIG. 13 is a perspective view of the stress-measuring portion of the present invention.
Figure 16:
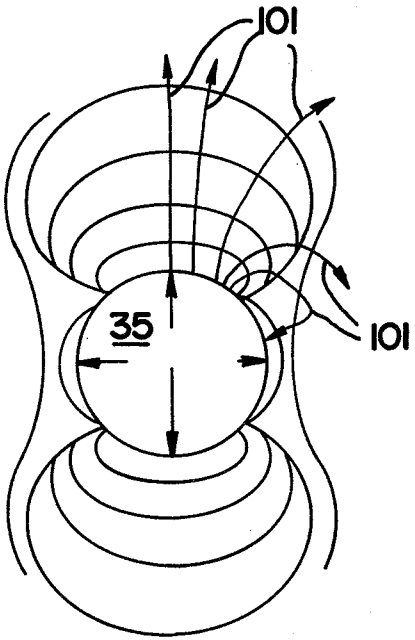
FIG. 16 is a schematic depiction of the stress contour and corresponding displacement patterns provided by the stress measuring portion of the present invention.

As shown in FIG. 16, the force exerted by the high pressure chambers 96 and 97 results in a generally symmetrical stress contour pattern. It is significant to note however, that existing stresses within the ground media will dictate the movement of the borehole boundary. As shown by arrows 101, the movement caused by the stress exerted by the expanding high pressure chambers is generally orthogonal to the stress contour lines. Measurement of this movement provides and indication of the insitu stress states and this information in turn may be used to determine the existing stress field in the ground media. As shown in FIG. 17, the diametrical expansion of the borehole wall by the chambers 96 and 97 results in a diametrical contraction in the orthogonal diametrical direction. The diametrical expansion as well as the orthogonal contraction is measured by the instrumentation of the probe member 35.

Figure 15:
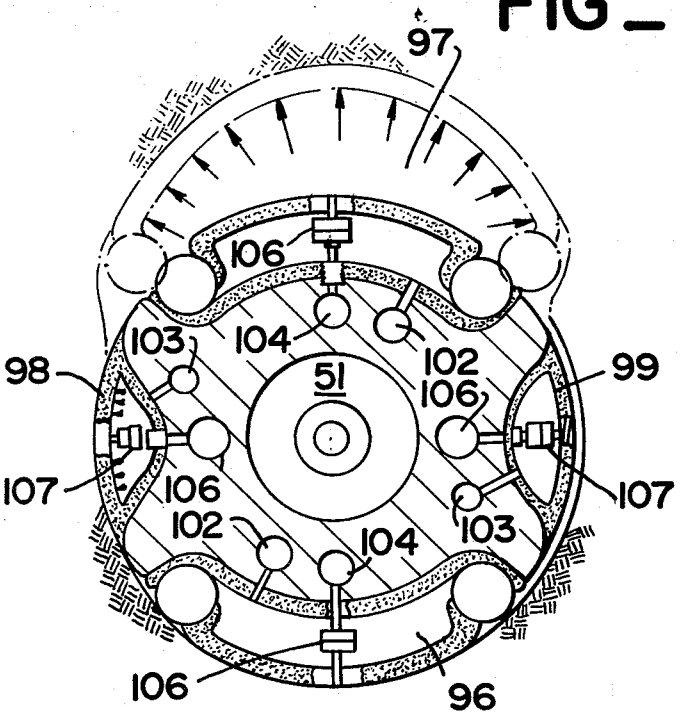
FIG. 15 is a cross-sectional view of the stress-measuring portion of the present invention.

In FIG. 15, the chamber 97 is shown in the expanded, pressurized disposition, while the chamber 96 is shown in the unpressurized, retracted position. It may be appreciated that in actual measurement procedures both chambers 96 and 97 would be actuated simultaneously. The high pressure hydraulic fluid is provided through passageways 102 which extend in the cylindrical member 35 parallel to the axis thereof. These passageways 102 are continuations of the supply galleries 64 of the property measuring portion 36, as shown in FIG. 12. The low pressure fluid for the chambers 98 and 99 is provided through passageways 103, which extend through the member 35 parallel to the axis thereof. The passageways 103 are not continuations of the low pressure supply galleries 67 of the member 36; rather the passage 103 is connected to the high pressure of passageway 102 through a limit pressure valve (not shown) which supplies the low pressure within a certain preset maximum pressure supply limit. The limiting pressure should be controlled according to need of individual testing.

The member 35 also includes pairs of cable passageways 104 and 106 for the high pressure and low pressure chambers, respectively, so that the signals from the transducers associated therewith may be conducted to the signal processing electronics in the supporting chamber.

It should be noted that the stress measuring probe 35 is also provided with a central bore 51 through which a drilling rod may extend to the drilling head 42.

Each of the expandable chambers 96 – 99 are formed of sealed envelopes of a flexible, elastic, high-strength material such as urethane plastic or the like. The inner panel of each envelope is supported by the underlying surface of the pocket in which it resides in the cylindrical member 35. Thus the pressurization introduced through the passage 102 or 103 causes the outer panel of each envelope to translate outwardly. The high pressure and low pressure chambers are provided with strain gauges 106 and 107 respectively which measure the relative expansion and contraction of the chambers so that the movement of the borehole wall under the applied pressure may be determined.

Figure 18:
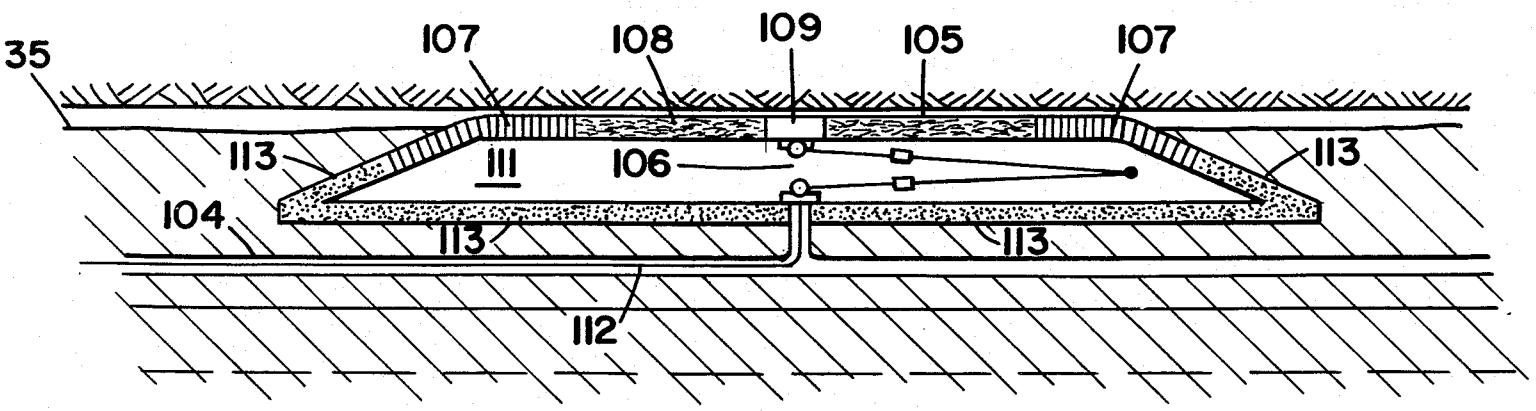
FIG. 18 is a detailed longitudinal cross-sectional view of a quadrant pressure expansion chamber of the stress measuring portion of the present invention.
Figure 19:
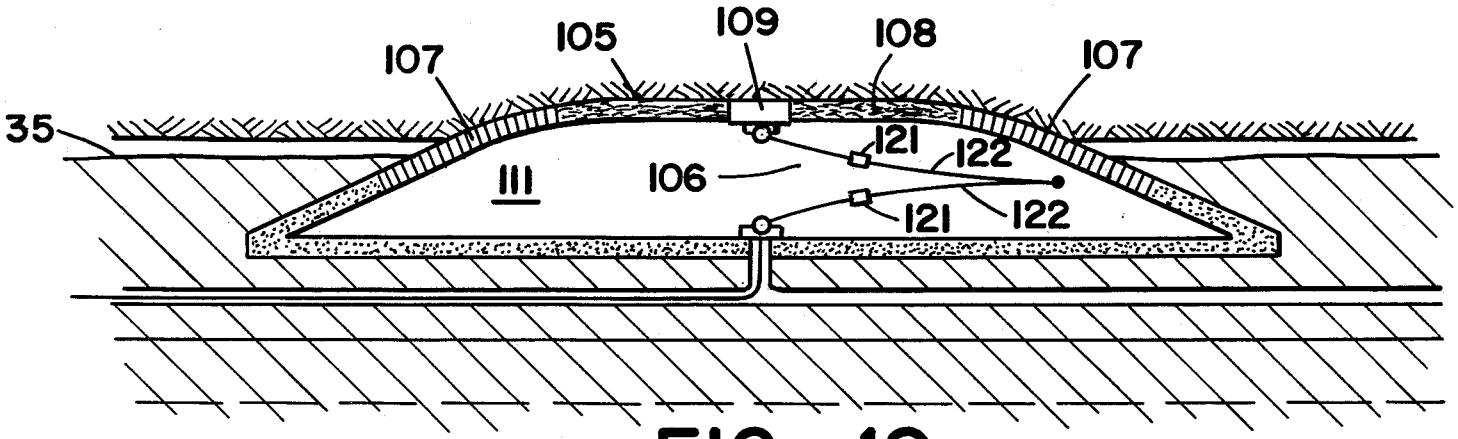
FIG. 19 is a longitudinal cross-sectional view as shown in FIG. 18, with the chamber in the expanded configuration.

As shown in the longitudinal cross-section of the high-pressure chambers of FIGS. 18 and 19, the outer panel of each high pressure envelope includes a pair of flexible metal seals 107 disposed in the general area at which the outer flexible panel intersects with the outer wall of the cylindrical member 35. The metal seals 107 are longitudinally spaced apart, and are joined by the outer envelope wall 105. This wall 105 is provided with fiber reinforcement 108 to accommodate the extremely high pressures which are contained within the cavity 111 of the high pressure chamber. The outer panel 105 is also provided with a central contact button 109 which is formed of high strength metal. Extending between the button 109 and the midpoint of the inner panel is the strain gauge device 106. Although many different strain gauge devices known in the prior art may be employed, the one shown in the preferred embodiment consists of four SR-4 strain gauges 121 attached to each side of two metal strips 122 formed in a wishbone configuration. The signal from the strain gauges 106 is conducted through a cable 112, which is disposed in the cable hole 104, to a wheatstone bridge detector.

As shown in FIG. 19, when high pressure is applied to the cavity 111 through the passageway 102, the flexible metal seals 107 expand outwardly, and the outer panel 105 impinges on the borehole wall. The radially outward displacement of the panel 105 causes the wishbone configuration of the strain gauge 106 to be widened, resulting in a change in the signal therefrom.

It should be noted that the inner panel of the envelope is cemented to the cylindrical member 35 in the area surrounding the cable exit hole, so that hydraulic pressure is contained and bag expansion is reduced in that area. Furthermore, a lubricant is applied to the portions 113 of the inner and outer panel of the envelope so that the panel may easily expand with respect to the adjacent surfaces of the member 35. This feature permits elastic yield of the portions 113 to accommodate some of the envelope expansion.

Figure 20:
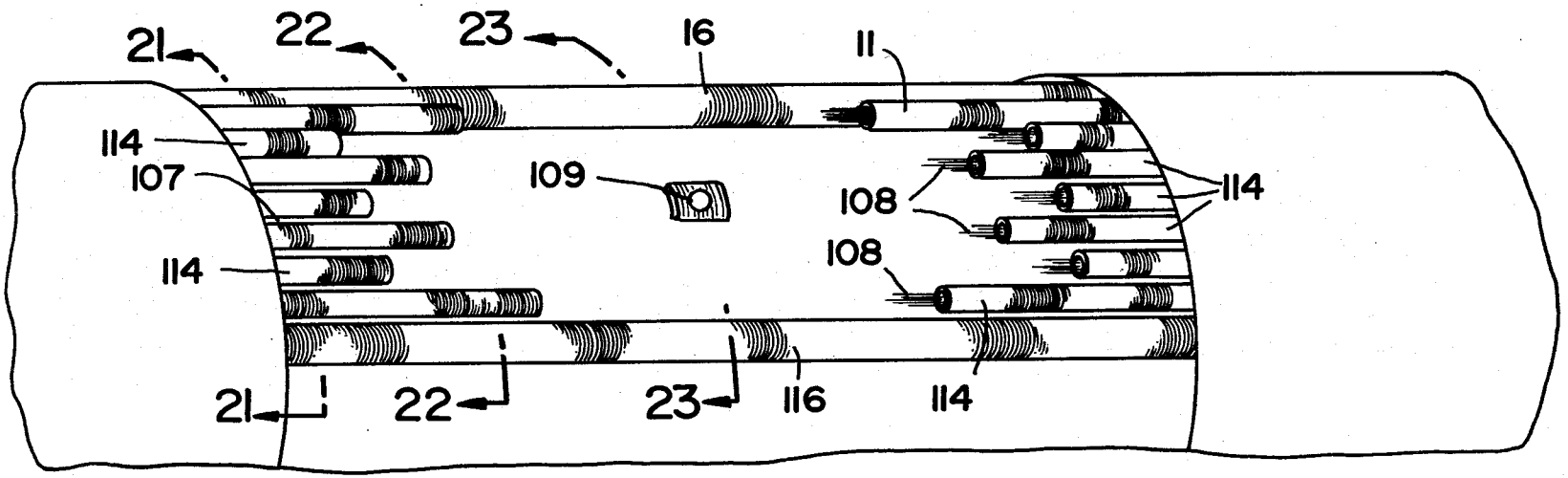
FIG. 20 is a perspective view of a quadrant pressure chamber shown in FIGS. 18 and 19.
Figure 23:
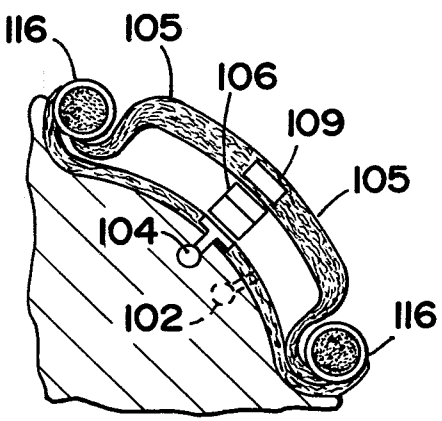
FIGS. 21 through 23 are detailed transaxial cross-sectional views of the structure of a quadrant expandable pressure chamber.
Figure 22:
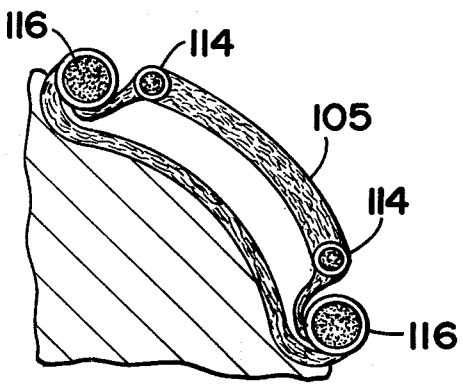
Figure 21:
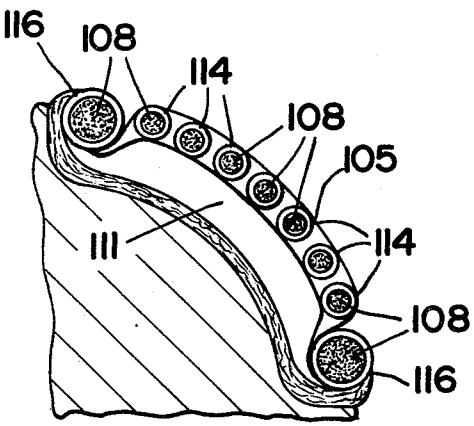

With reference to FIG. 20, the flexible metal seal 107 is formed of a plurality of helical coil springs disposed in adjacent relationship and embedded in the outer panel 105 from each high pressure chamber. The medially disposed coil springs 114 extend only a short distance from their respective ends of the outer panel of the envelope, to provide increased strength at the portions of the outer panel which experience the greatest expansion and stress. The hollow cores of the springs 114 are filled with the reinforcing fibers 108, such as high strength nylon or the like, which are embedded in and extend the entire length of the panel 105 and are received in the aligned, respective springs 114 at the other end of the envelope. It should be noted that the outer coil springs extend farther from the ends of the panel, to provide the added strength required in the upper panel.

Figure 24:
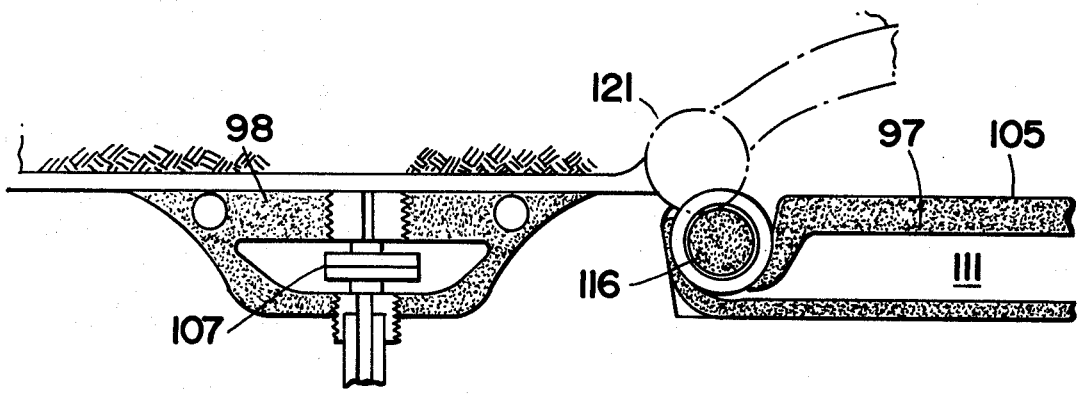
FIGS. 24 through 26 are detailed cross-sectional views of a quadrant expandable pressure chamber of the stress-measuring portion of the present invention.
Figure 25:
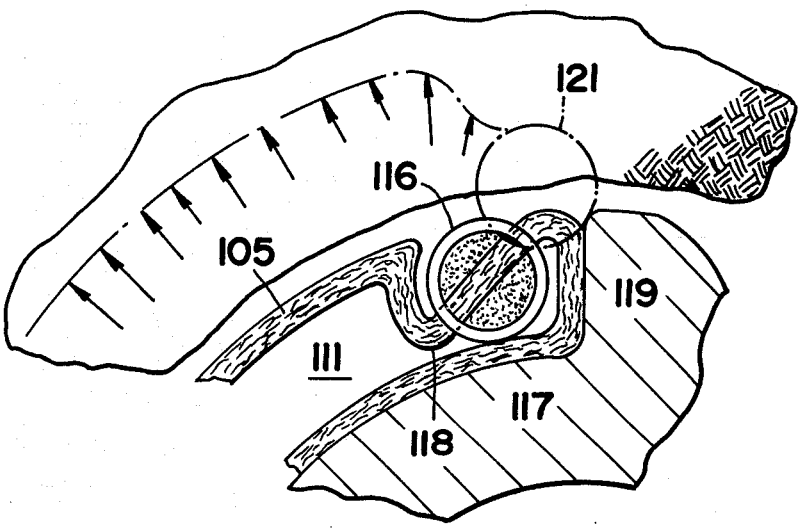
Figure 26:
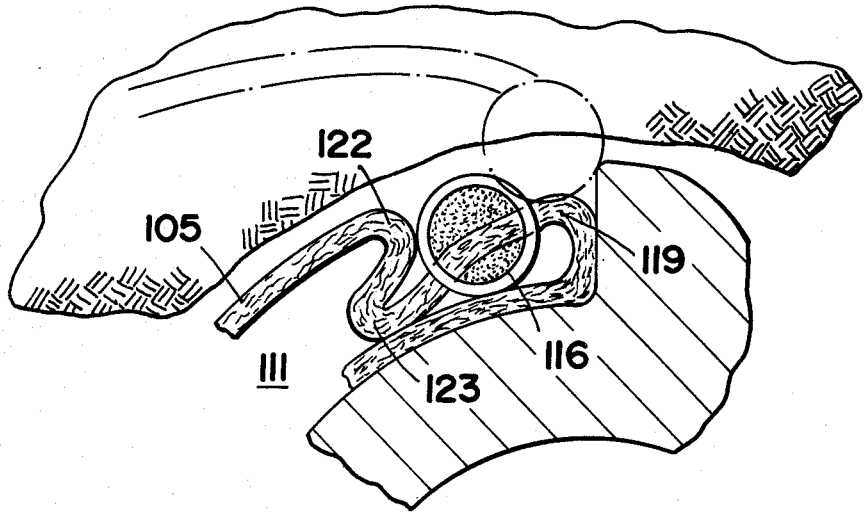

As shown in FIGS. 20 through 23, the circumferentially outermost coil springs 116 are larger in diameter than the springs 114. They are also filled with longitudinally extending reinforcing metal or plastic fibers 108. As shown in FIGS. 25 and 26, the coil springs 116 join the upper and lower panels of each high pressure chamber. In the retracted position, shown in FIG. 25, the upper panel 105 is folded along a longitudinal line adjacent to each of the springs 116. Likewise, the lower panel is folded downwardly as it intersects the coil spring 116. Furthermore, a plurality of circumferentially extending reinforcing fibers 117 extend from the circumferentially peripheral edge of the inner panel through the spring 116 to the folded portion of the upper panel 105. When the chamber 111 is inflated with high pressure hydraulic fluid, the upper panel 105 first expands along the fold lines 118 and 119. This initial unfolding motion drives the spring 116 into contact with the borehole wall, as shown in phantom line at 121, forming a seal therewith which limits the expansion of the joint between the upper and lower panels and prevents rupturing of the envelope. That is, the springs 116 form a longitudinally extending plug which impinges on the borehole wall to limit the radially outward movement of the periphery of the envelope. This motion is also shown in the linear diagrammatic representation of FIG. 24.

In situations in which soft soil or clay is to be examined with the present invention, it may be appreciated that the high pressure chambers will undergo greater expansion under the same hydraulic pressure, than when impinging upon hard rock. To accommodate this greater expansion, the upper panel 105 may be folded along longitudinal line 122 and 123 adjacent to the coil spring 116, so that the folded portions are overlying each other. This construction makes available more of the top panel 15 for radial outward expansion without unduly straining the reinforcing fibers and risking rupturing of the high pressure chamber.

An alternate embodiment of the stress probe includes an arrangement having the same high pressure chambers in all four quadrants since the high pressure chambers can perform also as a low pressure chamber. An advantage of this arrangement that is the stress probe may alternate the direction of loading and deformation without necessitating rotation of the probe, by alternating the opposed pairs inflated with high pressure. This will provide valuable information on boundary behaviors particularly in situations in which rotation of the probe is difficult without disturbing ground media, such as soils and sands.

Due to the resiliency of the reinforcing arrangement of the high pressure chambers, and the flexibility of the urethane fabric there is very little absorption of the applied pressure by the high pressure chamber itself. Therefore, the applied pressure of the hydraulic fluid in the chamber 111 is virtually the same as the actual loading on the borehole wall. Thus there is no need to measure the loading pressure at the borehole wall itself.

The stress probe is especially designed to be applicable to a wide variation of earth materials ranging from soft soils to hard rock. This feature truly distinguishes the present invention from all other existing devices since they are made to apply only to certain specific types of earth materials, such as clays, sand, and soft or hard rocks respectively. Also the probe of the present invention is much more reliable than any previous device. These unique advantages are accomplished by the following design features (combined together) in this invention:

1. Very large deformation capability of the pressure chambers.
2. No pressure loss in the large expansion of the chamber.
3. High pressure loading capability to produce yielding deformation in the surrounding materials.
4. Four quadrant arrangement of the pressure chambers enabling the differential loading for the material yielding.

A most salient feature of the present invention is the synergistic relationship between the stress measuring and property measuring portions thereof. That is, the properties ascertained through the measurements made by the property measuring portion are vital in interpreting the borehole deformation measurements made by the stress measuring portion. Due to the unique construction of the present invention, both the stress measurements and property measurements are made within the specific location of the ground media surrounding the borehole, so that errors due to anisotropy in the ground media are minimized or eliminated. It should also be noted that the present invention may be used repeatedly within the same borehole at different depths within the borehole to determine variations in properties of the ground media and stress fields surrounding the borehole.

Another salient feature of the present invention is the accommodation of the drilling rod through the axial passageway in the instrument of the present invention. This feature is particularly useful in soft soil which would require a borehole casing to maintain the integrity of the borehole. It may be appreciated that a borehole casing would interfere with the stress and property measurements of the present invention. The construction of the present invention obviates this problem.

Also, the self-drilling feature represents an advance over the prior art in that stress and property measurements may be taken during brief interruptions in the drilling procedure. Formerly, it was necessary to remove the drilling head and take core samples at selected depths. Aside from the stress relief which may destroy valuable information contained in the core samples, this procedure is known to be time-consuming and expensive. In contrast, the embodiment of the present invention which is carried on the drilling assembly affords direct measurement of the ground media properties and stress field with little interruption in the drilling procedure.

What is claimed is:

1. An apparatus for measuring material properties and ambient stresses in ground media surrounding a borehole, comprising a plurality of penetrometers supported in said first member, hydraulic means for controllably actuating said penetrometers to impinge on the wall of said borehole, means for measuring the penetration of said penetrometers as a function of time and loading force; a second member disposed in said borehole adjacent to said first member, said second member including means for simultaneously sensing the direction and magnitude of the stress field in said ground media surrounding said borehole.

2. The apparatus of claim 1, wherein said plurality of penetrometers are grouped in pairs, each pair being disposed in diametrically opposed relationship.

3. The apparatus of claim 2, wherein each pair of penetrometers includes a bore extending diametrically through said first member, and a pair of pistons disposed in the opposed ends of said bore.

4. The apparatus of claim 3, further including a centrally disposed, longitudinally extending hydraulic fluid gallery in said first member, said gallery communicating with and supplying hydraulic fluid to each bore of all of said pairs of said penetrometers.

5. The apparatus of claim 4, further including pressure means for selectively retracting said penetrometers from impingement with said borehole wall.

6. The apparatus of claim 2, wherein said first and second members both include a centrally disposed passageway therethrough for receiving a borehole drilling rod.

7. The apparatus of claim 6, wherein each of said penetrometers includes a radially extending bore disposed radially outwardly from said centrally disposed passageway, and a piston slidably disposed in said radially extending bore.

8. The apparatus of claim 7, wherein said first member includes a plurality of longitudinally extending hydraulic fluid galleries for supplying high pressure hydraulic fluid to the proximal portions of said radially extending bores.

9. The apparatus of claim 7, wherein each of said pistons includes a centrally disposed chamber opening radially inwardly, an LVDT coil disposed therein and anchored to said first member, and an LVDT core disposed within said coil and anchored to said piston.

10. The apparatus of claim 1, wherein said first and second members include a centrally disposed passageway extending therethrough for receiving a borehole drilling rod.

11. The apparatus of claim 1, wherein said means for measuring the penetration includes a displacement transducer associated with each of said penetrometers.

12. The apparatus of claim 1, wherein said means for sensing the stress field includes a pair of high pressure expandable chambers disposed in diametrically opposed relationship, and a pair of low pressure expandable chambers also disposed in diametrically opposed relationship, and expandable chambers being adapted to impinge on said borehole wall.

13. The apparatus of claim 12, wherein said expandable chambers are disposed in quadrant relationship about the axis of said borehole.

14. The apparatus of claim 13, wherein each of said expandable chambers includes means for measuring the deformation of said borehole wall under the pressure loading exerted by said high pressure chambers.

15. An apparatus for measuring material properties and ambient stresses in ground media surrounding a borehole, comprising a first member disposed in said borehole, said first member supporting means for determining the material properties of said ground media; and a second member disposed in said borehole adjacent to said first member, a plurality of expandable chambers, including a pair of high pressure expandable chambers secured in said second member and adapted to impinge on and deform the wall of said borehole, a pair of low pressure expandable chambers secured in said second member and adapted to impinge on said borehole wall, pressure means for inflating said expandable chambers, and means for measuring the deformation of said borehole under the pressure loading of said high pressure expandable chambers.

16. The apparatus of claim 15, wherein all of said expandable chambers are disposed in quadrant relationship about the axis of said borehole, like expandable chambers being disposed in diametrically opposed relationship, and wherein any opposed pair of expandable chambers may comprise said high pressure chambers.

17. The apparatus of claim 16, wherein said means for measuring the deformation includes a strain gauge device associated with each of said expandable chambers.

18. The apparatus of claim 16, wherein each of said expandable chambers includes an elastic, expandable envelope secured in a recess in the exterior of said second member.

19. The apparatus of claim 18, wherein said expandable envelopes include an inner and outer panel joined at their peripheral edges to define a pressure-tight cavity therein.

20. The apparatus of claim 19, wherein the outer panels of said envelopes of said high pressure expandable chambers include relatively stiff reinforcement means secured therein and said inner panels comprise elastic, expandable webs which yield to accommodate expansion of said envelopes.

21. The apparatus of claim 20, wherein said reinforcement means includes a plurality of coil spring members embedded in said outer panel.

22. The apparatus of claim 21, wherein said coil spring members are filled with reinforcing fibers.

23. The apparatus of claim 22, wherein said spring members are arrayed in longitudinally aligned adjacent relationship, and are disposed in the longitudinally opposed end portions of said outer panel.

24. The apparatus of claim 23, wherein said reinforcing fibers extend the longitudinal length of said outer panel.

25. The apparatus of claim 24, further including a pair of flexible end plugs extending along the laterally opposed edges of said outer panel.

26. The apparatus of claim 25, wherein said outer panel includes a folded, expandable portion extending adjacent to each of said flexible end plugs.

27. The apparatus of claim 25, wherein each of said flexible end plugs includes a large diameter coil spring embedded in said outer panel and filled with reinforcing fibers.

28. The apparatus of claim 15, wherein said pressure means includes at least one pressure supply passageway extending in common with said first and second members.

29. A method of determining the material properties and ambient stress field of a portion of ground media surrounding a borehole, comprising the steps of:

inserting a stress-material properties probe in said borehole, driving a plurality of penetrometers from said probe into the wall of said borehole, while simultaneously expanding an outer portion of said probe under high pressure to impinge on and deform said borehole wall, measuring the extension of said penetrometers into said borehole wall as a function of time and loading force, measuring the deformation of said borehole wall caused by said expanding outer probe portion as a function of time and loading force, and comparing said measurements with rheological models of ground media behavior to determine existing stresses and inherent properties of said ground media.

* * * * *